United States Patent [19]

Chu

[11] Patent Number: 4,936,294

[45] Date of Patent: Jun. 26, 1990

[54] MASSAGE DEVICE

[76] Inventor: Jennifer Chu, 4739 Cedar Ave., Philadelphia, Pa. 19143

[21] Appl. No.: 226,771

[22] Filed: Aug. 1, 1988

Related U.S. Application Data

[63] Continuation-in-part of Ser. No. 163,660, Mar. 3, 1988, abandoned.

[51] Int. Cl.[5] ..... A61H 15/00

[52] U.S. Cl. ..... 128/57; 128/62 R

[58] Field of Search ..... 128/33, 24 R, 24.4, 128/24.2, 24.3, 56, 57, 58, 60, 61, 62 R, 69

[56] References Cited

U.S. PATENT DOCUMENTS

| | | | |
|---|---|---|---|
| 662,083 | 11/1900 | McFadden | 128/57 |
| 793,527 | 6/1905 | King | 128/60 |
| 2,011,471 | 8/1935 | Casagrande et al. | 128/59 |
| 2,290,407 | 7/1942 | Collins | 128/48 |
| 3,205,887 | 1/1963 | Henry | 128/57 |
| 3,459,179 | 8/1969 | Olesen | 128/60 |
| 3,799,155 | 3/1974 | Gerlich | 128/62 |
| 4,169,466 | 10/1979 | Wong | 128/48 |
| 4,210,134 | 7/1980 | Okazaki et al. | 128/60 |
| 4,233,966 | 11/1980 | Takahashi | 128/67 |
| 4,383,342 | 5/1983 | Forster | 128/62 R |
| 4,421,110 | 12/1983 | DeLisle et al. | 128/60 |
| 4,577,625 | 3/1986 | Lohati et al. | 128/57 |
| 4,796,616 | 1/1989 | Panahpour | 128/57 |

FOREIGN PATENT DOCUMENTS

| | | | |
|---|---|---|---|
| 244189 | 3/1947 | Fed. Rep. of Germany | 128/57 |
| 1237639 | 10/1959 | France | 128/57 |
| 17534 | of 1887 | United Kingdom | 128/60 |
| 11966 | of 1915 | United Kingdom | 128/57 |
| 306254 | 2/1929 | United Kingdom | 128/57 |

*Primary Examiner*—Edgar S. Burr
*Assistant Examiner*—Kimberly L. Asher
*Attorney, Agent, or Firm*—Banner, Birch, McKie & Beckett

[57] ABSTRACT

A massage device having a substantially planar support of foamed plastic and a plurality of massaging elements in the form of halves of balls distributed uniformly about the support is disclosed. The massaging elements may be substantially the size and firmness of tennis balls and are secured to the support in closely-spaced parallel rows by sleeves in which the massaging elements are arranged end-to-end. The sleeves are gathered between adjacent massaging elements and are secured to the support between adjacent massaging elements.

7 Claims, 1 Drawing Sheet

MASSAGE DEVICE

CROSS REFERENCE TO RELATED APPLICATION

This application is a continuation-in-part of Ser. No. 163,660, filed Mar. 3, 1988, now abandoned.

TECHNICAL FIELD

The present invention relates to a massage device and, more particularly, to a massage device in the form of a substantially planar support having massaging elements on the surface thereof. The massage device may be used as a portable cushion or backrest with a seat, bed, or floor. A user may lean against the massage device and may move relative to the massage device to obtain a massaging effect. Alternately, the device may be held on the body by a massager.

BACKGROUND OF THE INVENTION

Among the various prior art devices for use for massaging purposes in the massaging apparatus disclosed in Wong, U.S. Pat. No. 4,169,466 which shows a plurality of glass or plastic balls, or beads arranged in rows on a panel-like double-walled support. The support has apertures through which the balls or beads project to provide a massaging surface and may be disposed, for example, on the back of a seat in an automobile to provide a massaging action to the driver resting against it. The massaging device disclosed by Wong is relatively expensive and is based on the use of relatively small and rigid balls or beads. Although the balls are rotatable in their sockets, they are not adapted to move relative to the support, thus limiting the massaging action that is obtainable.

Lohati et al., U.S. Pat. No. 4,577,625 shows a series of balls or beads tethered to a support such as a glove or a backrest. The balls are of plastic, wood, metal, or a material such as hard rubber. The balls are rigid and relatively small, and provide a limited massaging action particularly for someone using the device as a backrest.

Henry, U.S. Pat. No. 3,205,887 shows a massaging device in the form of a bed having a plurality of balls of sponge rubber or the like mounted in rows transversely of the bed on arms that are mounted for movement relative to the bed. The device is an active massager and is relatively complex and expensive and is not suitable for use, for example, as a cushion or backrest in a chair or seat.

Takahashi, U.S. Pat. No. 4,233,966 discloses a massage device that comprises a board on which a number of balls are adapted to be arranged in different patterns for different massaging effects. The device is designed to simulate the effects of a finger-pressure massage in areas of the body where the user cannot normally apply finger pressure, such as on the back.

Forster, U.S. Pat. No. 4,383,342 relates to a massage device that may be a backrest for a seat or a mattress having a plurality of fingers or ridges that are adapted to be deflected by the user leaning against or laying on the device. The fingers can be contoured to fit a person's back and are inclined to deflect longitudinally of the device to extend the spine. The device is not portable and is not adapted for use in preexisting or conventional seats.

Collins, U.S. Pat. No. 2,290,407 shows a massaging device in which the massaging elements are inflated rubber balls maintained in position by a flexible rubber covering.

The above mentioned devices are only some of the many different types of massaging devices that exist in the prior art. Despite the rather extensive development devoted in the past to massaging devices, there is no device that is simple, inexpensive, readily usable in a chair or vehicle seat, or on another support such as a backrest, and against which the user can lean or lay that will provide a suitable massaging action and against which the user can move either vertically or horizontally to vary and enhance the massaging effect.

SUMMARY OF THE INVENTION

Accordingly, it is an object of this invention to provide a massage device in the form of a cushion or pillow that can be used, for example, in seats to provide a massaging action, is relatively simple and inexpensive, provides suitable massaging action at spaced contact points while being sufficiently deformable to conform to the body of the user, and in which the massaging elements have limited mobility to permit movement of the user relative thereto to vary the massaging effect.

In accordance with this invention, there is provided a massage device having a relatively rigid and planar support that may be formed, for example, of foamed plastic on which a plurality of rows of massaging elements are mounted. The massaging elements are preferably hemispherical, such as halves of hollow rubber balls, with each row including a number of massaging elements arranged end-to-end in a sleeve that is secured to the support at its ends and at each point intermediate adjacent massaging elements. The sleeves are secured to the support by being gathered and tied between the massaging elements and connected, as by stitching or the like, to a covering on the support. The connection allows the massaging elements to move a limited amount relative to the support.

DETAILED DESCRIPTION OF THE INVENTION

Figure 1:
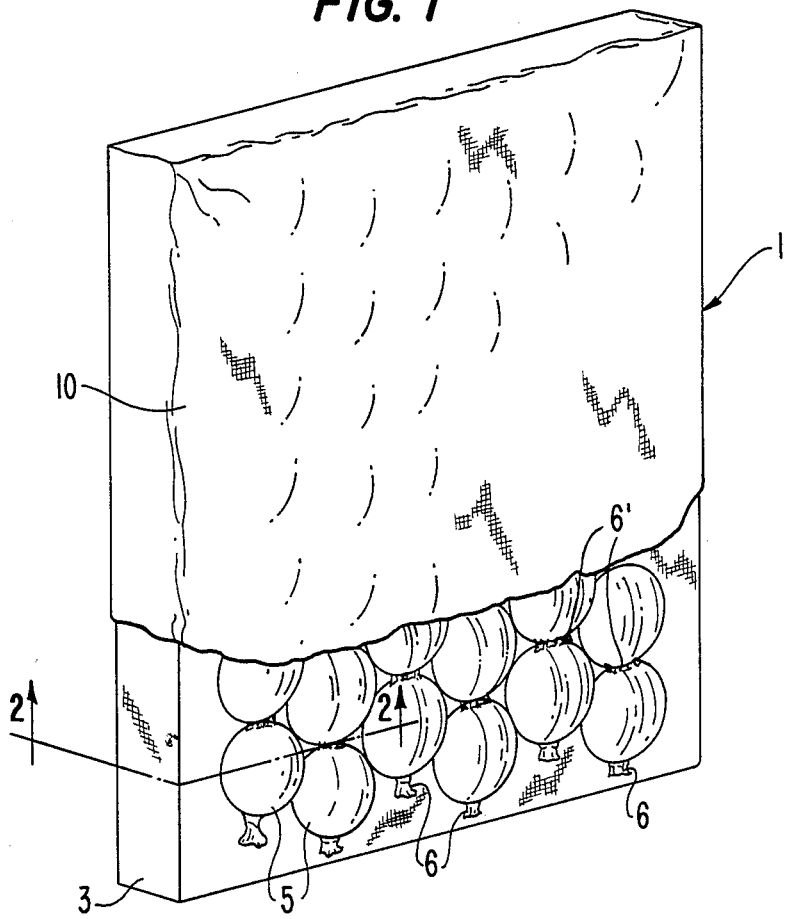
FIG. 1 is a perspective view of the massage device in accordance with this invention, with the outer cover member partly broken away to show the underlying elements.
Figure 2:
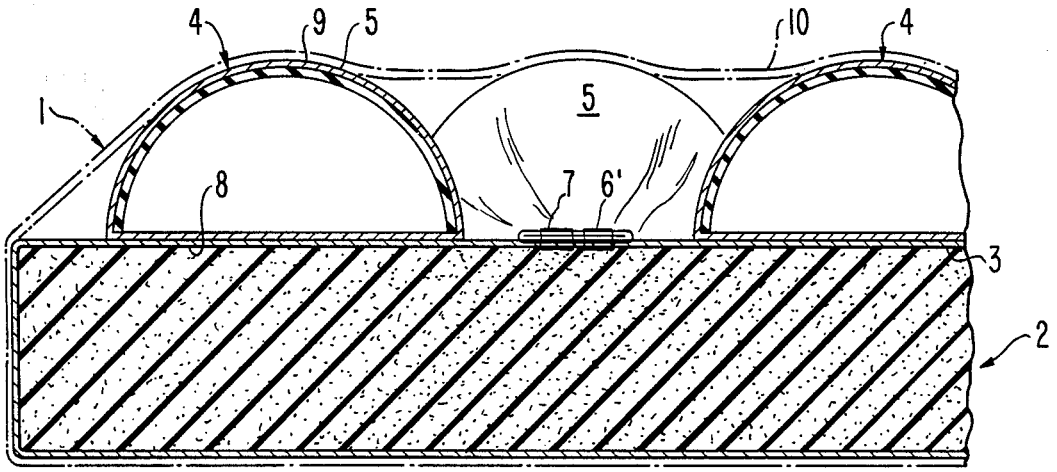
FIG. 2 is a fragmentary sectional view substantially on the line 2—2 of FIG. 1.

With reference to the drawings, a cushion or backrest 1 includes a substantially planar support 2. Support 2 preferably is made of foam plastic about two inches thick and relatively rigid but adapted to conform to some extent to nonplanar surfaces and to provide a lightweight support with a soft feel. Alternatively, support 2 may be a pair of sheets of foam plastic that are, for example, ½ inch thick. A rigid sheet that may be of ¼ inch plywood or cardboard is sandwiched between the foam sheets which provide a relatively soft feel while the rigid sheet provides sufficient rigidity and minimizes the thickness of the support. The support should be relatively thin to avoid reducing excessively the depth of the seat in which it is to be used. Support 2 is substantially planar and is covered by a support or inner cover 3 that is made of fabric and secures massaging elements 4 to the support.

Massaging elements 4 are resilient and hemispherical, each preferably being formed of one-half of a rubber ball roughly comparable in size and firmness to a tennis ball. Massaging elements 4 are arranged end-to-end in sleeves 5. Sleeves 5 are gathered and tied at gathering points 6 and 6' at their ends and between adjacent massaging elements 4. Sleeves 5 are secured by stitching 7 at gathering points 6 and 6' to inner cover 3 at their ends as well as between adjacent massaging elements. As assembled, massaging elements 4 are disposed with flat faces 8 facing support 2 and inner cover 3. The massaging elements lay flush on support 2 with the domed or hemispherical portions 9, which form the massaging surfaces, projecting from support 2.

As shown, there are six sleeves 5 with seven massaging elements 4 in each. Sleeves 5 are arranged longitudinally of support 2 in closely-spaced rows that are substantially parallel. Alternate rows are offset longitudinally of support 2 by one half of the width of the massaging elements so that the massaging elements in adjacent rows are staggered transversely of support 2 with the massaging elements in each row being disposed laterally opposite stitching 7 between massaging elements in the adjacent rows. The massaging elements are thus distributed uniformly and equally about the surface of support 2. Alternately, the sleeves may be placed in rows which are not staggered transversely. Cushion 1 is covered by outer cover 10 that provides a finished appearance to the device and stabilizes the assembly.

With massaging elements 4 secured to inner cover 3, they have limited movement both longitudinally and transversely of support 2. The amount of the movement is dependent on how tightly stiching 7 secures gathering points 6 and 6' of sleeves 5 to inner cover 3 and how tightly inner cover 3 is fitted to support 2.

Typically support 2 is rectangular and about 15×21 inches and massaging elements 4 are halves of rubber balls that are about 2½ inches in diameter—roughly the size and firmness of a tennis ball. Alternately, the size of the support may be larger to accommodate larger people, and may be 17×21 inches, 19×21 inches, or any other suitable size. Massaging elements 4 are spaced along sleeves 5 only enough to permit sleeves 5 to be gathered at gathering points 6 and 6' without distorting the massaging elements while the portion of sleeve 5 beneath the massaging elements is drawn smoothly underneath flat faces 8. Massaging elements 4 are seated on support 2 and are held by sleeve 5 against dislocation relative to support 2 while being free to move about on support 2 a limited amount.

In use, device 1 is placed, for example, against the back of a seat with massaging surface 9 of massaging elements 4 extending outwardly. When a user leans against device 1, massaging surfaces 9 provide an irregular surface that engages the back at spaced points and provides massaging action. The resilience of massaging elements 4 provides counterpressure and permits massaging elements 4 to deform and to adjust to the configuration of the back. Massaging elements 4 can deform sufficiently to bring most of the massaging elements across the back of the user. This is in contrast to a device with rigid massaging elements that not deform and which therefore define fixed contact points, or which are relatively small and are capable of limited deformation only. By applying pressure against only a portion of the device, certain massaging elements 4 can move slightly relative to other massaging elements 4 to vary the spacing between adjacent massaging elements 4 and thus vary the massaging action. By moving laterally or longitudinally of the device while leaning against it, the user also can deform massaging elements 4 at their edges, thus providing a limited rolling action to further vary the massaging action. The device is also light in weight and can be used as a massaging device that is rolled across the back by the user or by another person.

The massaging effect depends to a large extent upon the resilience of massaging elements 4. Massaging elements 4 that are relatively rigid would not conform to the configuration of the back. On the other hand, massaging elements that are too soft would provide little or no massaging action. At the same time, as the size of the massaging elements decreases and the density of the massaging elements on support 2 increases, the surface defined by the massaging elements approaches a continuous surface with only limited massaging capability, whereas, ideally, the massaging elements should be designed to simulate in spacing and pressure the contact normally experienced from the fingers in a manual massage. This has been substantially achieved in the massaging device as herein disclosed in which the contact points of the massaging elements are spaced less than three inches apart, extend over one inch from support 2, and have a firmness sufficient to provide adequate massaging action.

The device in accordance with this invention is designed particularly for use, for example, by business people or truck drivers who spend considerable time in a chair or seat or by patients in a rehabilitation center. However, it can be used universally on a chair, a bed, or the floor, or as a hand-held massage device.

While the present invention has been described in connection with a preferred embodiment, various alternatives or modifications will, of course, be apparent. For example, a wedge may be applied at the neck or lower back, with or without individual massaging elements, to provide a massaging action in areas not normally contacted by a planar device. Velcro straps may also be used to engage around the back of a chair or seat to hold the device in position. Other adaptations will also be obvious.

I claim:

1. A massage device comprising a support and a plurality of rows of massaging elements mounted on said support in closely-spaced substantially parallel rows with said massaging elements arranged uniformly about said support and having limited movement relative to said support, a sleeve for containing each of said rows of massaging elements, a plurality of said massaging elements being arranged end-to-end in said sleeve, and securing means for securing each of said sleeves to said support at the ends thereof and intermediate adjacent massaging elements to effect individual attachment of each massaging element to said support while permitting limited movement of said massaging elements, said massaging elements of alternate rows being offset endwise of said rows relative to said massaging elements of the intermediate rows whereby said massaging elements of each row are disposed opposite said intermediate securing means of said adjacent rows, said massaging elements having rounded massaging surfaces projected from said support, wherein said massaging elements are resilient to conform to the body of a user during use and to spring back to their original shape after use.

2. A massage device in accordance with claim 1 in which said securing means comprises an inner cover enclosing said support and means for securing said sleeves to said inner cover.

3. A massage device in accordance with claim 1 in which said massaging elements comprise ball means.

4. A massage device in accordance with claim 3 in which said ball means are hemispherical and comprise one-half of a ball with the flat portion thereof facing said support.

5. A massage device in accordance with claim 3 in which said ball means have substantially the size and firmness of a tennis ball.

6. A massage device in accordance with claim 1 in which said support is substantially planar and comprises foamed plastic.

7. A massage device in accordance with claim 1 having an outer cover about said support and massaging elements.

* * * * *